US006722585B1

(12) United States Patent
Stradella

(10) Patent No.: US 6,722,585 B1
(45) Date of Patent: Apr. 20, 2004

(54) FLUID SPRAY HEAD INCLUDING A CLOSURE MEMBER

(75) Inventor: Giuseppe Stradella, Camogli (IT)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/958,924

(22) PCT Filed: Apr. 13, 2000

(86) PCT No.: PCT/FR00/00954

§ 371 (c)(1),
(2), (4) Date: Oct. 16, 2001

(87) PCT Pub. No.: WO00/62939

PCT Pub. Date: Oct. 26, 2000

(30) Foreign Application Priority Data

Apr. 20, 1999 (FR) ..... 99 04978

(51) Int. Cl.[7] ..... B05B 1/30; B05B 1/34; B05B 15/00; B65D 25/40; B65D 35/38

(52) U.S. Cl. ..... 239/533.13; 239/463; 239/483; 239/490; 239/546; 239/602; 222/491; 222/494

(58) Field of Search ..... 239/533.13, 533.1, 239/533.14, 533.15, 546, 602, 569, 570, 571, 461, 463, 464, 482, 483, 490–493; 222/490, 491, 492, 493, 494, 495, 496, 497

(56) References Cited

U.S. PATENT DOCUMENTS 3,545,682 A * 12/1970 Beard ..... 239/469
4,182,496 A * 1/1980 Burke ..... 239/492
4,257,561 A 3/1981 McKinney
4,884,750 A * 12/1989 Werding ..... 239/337
5,439,178 A 8/1995 Peterson
5,454,494 A * 10/1995 Lechelle ..... 222/494
5,769,325 A * 6/1998 Jouillat et al. ..... 239/337
5,842,616 A * 12/1998 Ruscitti et al. ..... 222/321.3
5,855,322 A * 1/1999 Py ..... 239/11

FOREIGN PATENT DOCUMENTS

EP 0 845 299 A 6/1998
FR 2 767 311 A 2/1999
NL 6 918 423 A 6/1971
WO WO 94/27732 * 12/1994 ..... 239/337

* cited by examiner

*Primary Examiner*—Michael Mar
*Assistant Examiner*—Darren Gorman
(74) *Attorney, Agent, or Firm*—Sughrue Mion, PLLC

(57) ABSTRACT

A spray head (1) for spraying fluid through a spray orifice (7), the head being provided with an expulsion channel (5), and with a closure member disposed in fixed manner in the expulsion channel (5), upstream from the spray orifice (7), the closure member comprising a closure element (9) which, at rest, closes off the spray orifice (7), and an elastically-deformable portion (10) supporting the closure element (9) for opening the spray orifice (7), the spray head (1) further being provided with a spray profile, the spray head being characterized in that the spray profile is formed on the closure member.

16 Claims, 2 Drawing Sheets

FLUID SPRAY HEAD INCLUDING A CLOSURE MEMBER

FIELD OF THE INVENTION

The present invention relates to a fluid spray head including an improved closure member for closing off the spray orifice, and in particular an improved closure member that is adaptable to spray devices of standard type.

Closure members of a variety of types are well known in the state of the art.

BACKGROUND

The present invention is applicable more particularly to fixed closure members which are deformed under the effect of the pressure of the fluid when the spray device is actuated.

In most spray devices, the portion producing the spraying of the fluid to be dispensed has a particularly critical geometrical shape that should not be degraded in order to obtain a spray that is sprayed appropriately. That portion is usually formed in the end wall of the spray head, in the form of narrow channels disposed at various angles and connected to the spray orifice. The fluid is thus forced to swirl as it goes through said spray orifice. The end walls of the channels can be formed either by the end of a part fixed rigidly in the expulsion channel, or by the closure member itself.

Documents FR-2 767 311, FR-2 524 348, and EP-0 845 299 disclose that type of device.

When manufacturing spray heads for spray devices, one of the most difficult steps concerns forming a swirl profile of appropriate shape. Firstly, the end wall of the expulsion channel of the head is a long way from the point at which the plastics material is injected into the mold. Secondly, the thickness of said end wall is relatively small and it varies due to the shape of the spray head, in particular when in a pusher for a nasal applicator. As a result, there is a risk that the swirl profile might be deformed, and the forming of the profile is difficult to control and requires complicated and costly tooling.

Furthermore, in devices in which, to save having to use an additional part, it is the closure member itself that forms the end wall of the swirl chamber, the problem arises of said profile being deformed progressively due to the compression force exerted on the deformable portion of the closure member to urge said closure member into its leaktight closure position. Thus, in particular in Document EP-0 845 299, the compression force exerted by the top end of the insert on the deformable membrane may cause it to deform, thereby modifying or even degrading the swirl profile considerably.

Document NL-6 918 423 discloses a moving closure member incorporating a helix on its outside. That closure member moves away from the dispensing orifice when the device is actuated, thereby significantly modifying the geometrical shape of the spray profile while dispensing is taking place.

SUMMARY OF THE INVENTION

An object of the present invention is to provide a closure member for closing off the spray orifice of a fluid spray device that does not reproduce the above-mentioned drawbacks.

In particular, an object of the present invention is to provide a spray head including a closure member, and whose spray profile is simple, reliable and inexpensive to form.

Another object of the present invention is to provide a closure member that is capable of achieving both leaktight closure of the device, and reliable opening thereof when the device is actuated.

A further object of the present invention is to provide such a closure member that substantially does not modify the geometrical shape of the spray profile of the device during opening thereof.

Another object of the present invention is to provide a closure member that makes it possible to minimize the size of the dead volume, and therefore that avoids the need for complex priming of the spray pump and/or the use of special pumps that are not of standard type. In addition, this makes it possible to guarantee improved protection for the fluid to be dispensed.

Another object of the present invention is to provide a closure member and a spray head including said closure member that are simple and inexpensive to manufacture and to assemble.

The present invention thus provides a spray head for spraying fluid through a spray orifice, said head being provided with an expulsion channel, and with a closure member disposed in fixed manner in the expulsion channel, upstream from said spray orifice, said closure member comprising a closure element which, at rest, closes off the spray orifice, and an elastically-deformable portion supporting said closure element for opening the spray orifice, said spray head further being provided with a spray profile, said spray head being characterized in that the spray profile is formed on said closure member.

Advantageously, said spray profile includes one or more spray channels.

Advantageously, said spray profile includes a swirl chamber around said closure element.

Preferably, said expulsion channel is substantially cylindrical and it is provided with a substantially cylindrical hollow internal insert, said closure member including a substantially cylindrical portion fixed around said insert, said elastically-deformable portion of said closure member forming the end wall of said cylindrical portion of the closure member, said spray profile being formed on said cylindrical portion and/or on said deformable portion of the closure member.

Advantageously, said cylindrical portion of the closure member is provided with a plurality of ribs spaced apart around the periphery and defining between them a plurality of first spray channels.

In particular said first channels extend vertically or on a slant over said cylindrical portion of said closure member.

Advantageously, said deformable portion is provided with a plurality of projections defining between them a plurality of second spray channels and/or a swirl chamber.

Preferably, the closure member is fixed to the insert by a peripheral groove provided in the cylindrical portion of the closure member, which groove co-operates with an annular projection of said insert, so that no compression force is exerted by the top end of the insert on the deformable portion of the closure member, when the closure member is in the rest position.

The present invention also provides a spray device for spraying a fluid, said spray device including a spray head as defined above.

The present invention also provides a closure member as defined above.

Other characteristics and advantages of the present invention appear from the following detailed description of the invention given by way of non-limiting example and with reference to the accompanying drawings, in which:

DETAILED DESCRIPTION OF THE INVENTION

Figure 3:
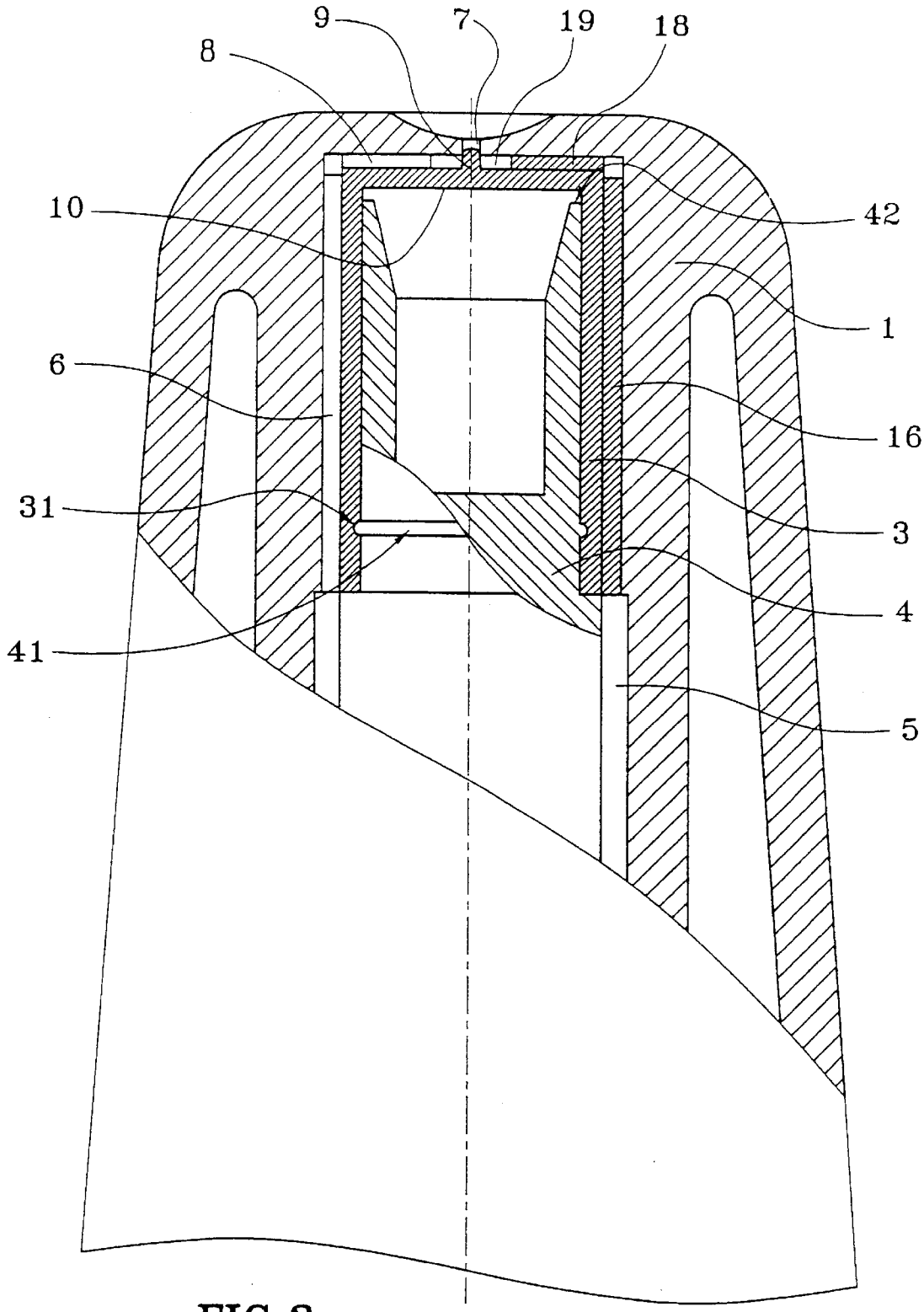
FIG. 3 is a diagrammatic section view of a spray head of standard type in an advantageous embodiment of the present invention and including the closure member of FIG. 1.

As shown in the figures, the closure member of the invention mainly comprises a closure element 9 disposed on an elastically-deformable portion 10 of the closure member. The closure element 9 is advantageously 35 implemented in the form of a conical spike, and it is mounted to move between a closure position in which it closes off the dispensing orifice 7, as shown in FIG. 3, and an opening position in which it opens said dispensing orifice 7. More particularly, the closure member is disposed in fixed manner inside the expulsion channel 5, 6 of a spray head 1 of a spray device for spraying a fluid, and upstream from the dispensing orifice 7. The closure element 9, as fixed to said elastically-deformable portion 10 of the closure element, is, at rest, resiliently urged into its closure position. When the device is actuated, the pressure generated by the fluid deforms the elastically-deformable portion 10 of the closure member, thereby moving the closure element 9 from its closure position to its opening position, so as to enable the fluid to be expelled through the dispensing orifice. In particular, the closure member 10 is moved axially away from the orifice 7. Thus, the closure member of the present invention is disposed in fixed manner in the expulsion channel and upstream from the dispensing orifice, and only the closure element 9 is moved by the resilience of the elastically-deformable portion 10. As shown in the figures, said elastically-deformable portion 10 preferably forms a radial flange disposed in the vicinity of said dispensing orifice 7, said deformation taking place as from a predetermined pressure exerted by said fluid on said elastically-deformable portion. Advantageously, this elastically-deformable portion 10 is made of an elastomer material. Preferably, the closure element 9 is made integrally with said elastically-deformable portion 10, the resulting single part preferably being made of an elastomer material. In this way, the closure member of the invention is very simple to manufacture and is inexpensive, while being fully reliable and leaktight. Naturally, any suitable flexible material may be used for the closure member, or at least for its resiliently-deformable portion 10.

In the invention, the end wall of the spray head 1 is made so that it is smooth or plane, and it is the closure member that incorporates a swirl profile. Preferably, the closure member of the invention has a general shape similar to the closure member disclosed in Document FR-2 767 311 which is cited herein by way of reference. The closure member thus has a substantially cylindrical portion 3, the elastically-deformable portion 10 forming the end wall of said cylindrical portion 3.

Figure 1:
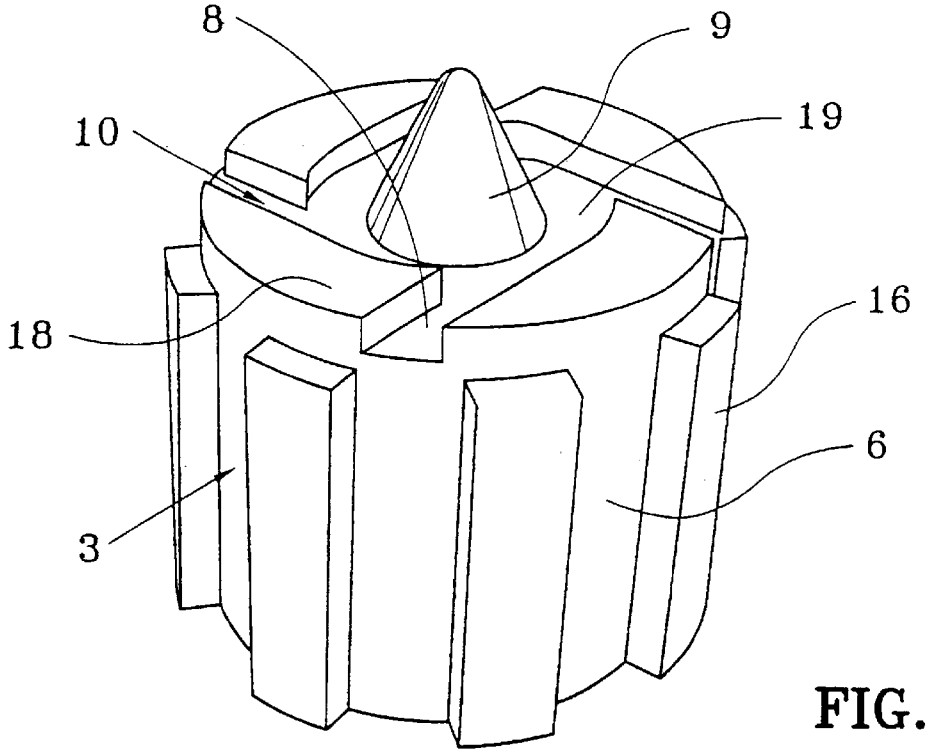
FIGS. 1 and 2 are diagrammatic perspective views of two embodiments of a closure member of the present invention.
Figure 2:
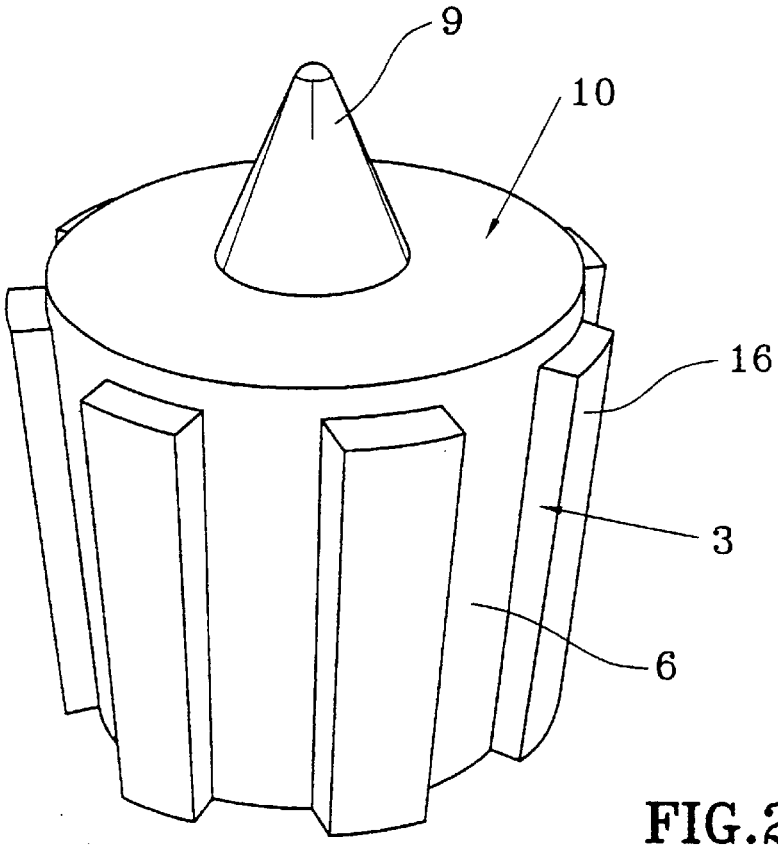

FIGS. 1 and 2 show respective ones of two embodiments of a closure member of the invention. In the embodiment shown in FIG. 1, the closure member has a spray profile both on its cylindrical portion 3 and on its elastically-deformable portion 10. Thus, the cylindrical portion is provided with a plurality of ribs 16 defining first spray channels 6 between them. The channels 6 may be vertical, as shown in FIGS. 1 and 2, but they could also be slanting, in particular in the embodiment of FIG. 2, in which there is no spray profile on the elastically-deformable portion. In FIG. 1, the elastically-deformable portion is provided with a plurality of projections 18 that, between them, define second spray channels 8 and a swirl channel 19 around the closure member 9. This is a usual spray profile. Naturally, the pattern of the spray profile may be of any configuration.

In the example shown in FIG. 2, the spray profile on the cylindrical portion 3 of the closure member may suffice to guarantee good spraying, in particular when the space between the end wall of the head and the elastically-deformable portion is minimal.

In any event, when the device is actuated, and thus when the closure member is opened, the geometrical shape of the spray channels 6 and/or 8 is not modified or modified only slightly by the closure element 9 moving from its closure position to its opening position. The closure member of the present invention thus makes it possible to guarantee good spraying in spite of its presence at the dispensing orifice.

FIG. 3 shows an advantageous embodiment of the closure member of the present invention. In this embodiment, the closure member is fixed around the insert 4, inside a spray head 1 of standard type.

Fixing the closure member to the insert is performed in this example at the cylindrical portion 3 of the closure member, e.g. by means of an internal annular groove 31 that co-operates with an annular side projection 41 formed on the insert 4. In this way, no contact is necessary between the top end 42 of the insert 4 and the elastically-deformable portion 10 of the closure member. Thus, no compression force is exerted at rest on the elastically-deformable portion, and there is thus no risk of said portion being deformed permanently, and thereby degrading the spray profile.

The closure member of the present invention thus makes it possible to offer the following advantages:

- the swirl profile of the spray head on the closure member is very simple and reliable, and therefore inexpensive, to form;
- the absence of compression stresses on the elastically-deformable portion of the closure member in the rest position prevents the swirl profile from deteriorating by the material deforming, and thus increases the life span of the closure member, of the spray head, and of the spray device;
- opening the closure member does not modify or modifies only slightly the geometrical shape of the spray profile during expulsion of the fluid, thereby guaranteeing excellent spraying;
- the closure member is disposed in fixed manner in the expulsion channel, thereby making it possible to minimize the dead volume, unlike in devices that have a piston mounted to move in the expulsion channel; and
- both for the pump and for the spray head, standard technology may be used with the present invention, thereby considerably limiting the overall manufacturing and assembly costs.

What is claimed is:

1. A spray head (1) for spraying fluid through a spray orifice (7), said head being provided with an expulsion channel (5), and with a closure member disposed in fixed manner in the expulsion channel (5), upstream from said spray orifice (7), said closure member comprising a fixed portion (3) fixed relative to the spray orifice (7), and an elastically-deformable portion (10) supporting a closure element (9) which, at rest, closes off the spray orifice (7), and which, when the elastically-deformable portion (10) deforms, opens the spray orifice (7), said spray head (1) further being provided with a spray profile, said spray head being characterized in that the spray profile is formed on said deformable portion (10) of said closure member; and wherein the closure element cooperates directly with the spray orifice such that, when the elastically-deformable portion deforms, the closure element opens the spray orifice; and wherein the fixed portion is non-deformable.

2. A spray head according to claim 1, in which said spray profile includes one or more spray channels (6,8).

3. A spray head according to claim 1, in which said spray profile includes a swirl chamber (19) around said closure element (9).

4. A spray head according to claim 1, in which said expulsion channel (5) is substantially cylindrical and is provided with a substantially cylindrical hollow internal insert (4), said fixed portion (3) of the closure member being substantially cylindrical (3) and fixed around said insert (4), said elastically-deformable portion (10) of said closure member forming the end wall of said cylindrical portion (3) of the closure member, said spray profile being formed on said cylindrical portion (3) and/or on said deformable portion (10) of the closure member.

5. A spray head according to claim 4, in which said cylindrical portion (3) of the closure member is provided with a plurality of ribs (16) spaced apart around the periphery and defining between them a plurality of first spray channels (6).

6. A spray head according to claim 5, in which said first channels (6) extend vertically or on a slant over said cylindrical portion (3) of said closure member.

7. A spray head according to claim 4, in which the closure member is fixed to the insert (4) by a peripheral groove (31) provided in the cylindrical portion (3) of the closure member, which groove cooperates with an annular projection (41) of said insert (4), so that no compression force is exerted by the top end (42) of the insert (4) on the deformable portion (10) of the closure member, when the closure member is in the rest position.

8. The spray head according to claim 7, wherein a gap exists between the top end (42) of the insert (4) and the deformable portion (10) of the closure member when the closure member is in the rest position.

9. A spray device for spraying a fluid, said spray device being characterized in that it includes a spray head (1) according to claim 1.

10. A closure member, characterized in that it is as defined in claim 1.

11. The spray head according to claim 1, wherein the spray orifice is formed at an outlet of the spray head so as to spray fluid from the spray orifice directly into the atmosphere outside the spray head.

12. The spray head according to claim 1, wherein the closure element cooperates directly with the spray orifice such that when elastically-deformable portion deforms the closure element is retracted away from the spray orifice.

13. The spray head according to claim 1, wherein the spray profile is a swirl profile formed by projections on said deformable portion of said closure member.

14. The spray head according to claim 1, wherein another spray profile is formed on the fixed portion of the closure member.

15. The spray head according to claim 14, wherein the spray profile formed on the fixed portion of the closure member is defined by longitudinal ribs extending on an outer peripheral surface of the closure member.

16. A spray head (1) for spraying fluid through a spray orifice (7), said head being provided with an expulsion channel (5), and with a closure member disposed in fixed manner in the expulsion channel (5) upstream from said spray orifice (7), said closure member comprising a fixed portion (3) fixed relative to the spray orifice (7), and an elastically-deformable portion (10) supporting a closure element (9) which, at rest, closes off the spray orifice (7), and which, when the elastically-deformable portion (10) deforms, opens the spray orifice (7), said spray head (1) further being provided with a spray profile, said spray head being characterized in that the spray profile is formed on said fixed portion (3) and/or on said deformable portion (10) of said closure member; and wherein said expulsion channel (5) is substantially cylindrical and is provided with a substantially cylindrical hollow internal insert (4), said fixed portion (3) of the closure member being substantially cylindrical (3) and fixed around said insert (4), said elastically-deformable portion (10) of said closure member forming the end wall of said cylindrical portion (3) of the closure member, said spray profile being formed on said cylindrical portion (3) and/or on said deformable portion (10) of the closure member; and wherein said deformable portion (10) is provided with a plurality of projections (18) defining between them a plurality of second spray channels (8) and/or a swirl chamber.

* * * * *